United States Patent [19]

DeMaagd

[11] Patent Number: 5,052,209

[45] Date of Patent: Oct. 1, 1991

[54] PANEL FLANGE OPENER FOR VEHICLE PANELS

[76] Inventor: Bernard E. DeMaagd, P.O. Box 492774, Redding, Calif. 96049

[21] Appl. No.: 446,389

[22] Filed: Nov. 30, 1989

[51] Int. Cl.[5] ..... B21D 1/12

[52] U.S. Cl. ..... 72/458; 72/479; 81/488

[58] Field of Search ..... 72/457, 458, 479; 81/488; 29/270

[56] References Cited

U.S. PATENT DOCUMENTS

| | | | |
|---|---|---|---|
| 2,878,699 | 3/1959 | Stricklett | 72/458 |
| 3,091,983 | 6/1963 | Kliss | 72/458 |
| 3,406,412 | 10/1968 | Kottas | 81/488 |
| 3,908,438 | 9/1975 | Norden | 72/458 |
| 4,116,034 | 9/1978 | Ruediger | 72/458 |
| 4,555,929 | 12/1985 | McBee | 72/458 |
| 4,926,536 | 5/1990 | Kohut | 29/243.58 |

FOREIGN PATENT DOCUMENTS

| | | | |
|---|---|---|---|
| 2455545 | 5/1976 | Fed. Rep. of Germany | 72/479 |

*Primary Examiner*—David Jones

[57] ABSTRACT

A pair of hand held tools with one having a handle (10), and shaft (12) to provide a means of control and safe working distance. The body of this tool features a flange lip groove (18) which keeps the tool on the area being worked, a leverage rack (22) that provides a guide for the leverage pick and a means of pulling the panel flange lip away from the panel frame. A second hand held tool, the leverage pick and featuring a handler (32) and shaft (36) with a flared, flattened, angled tooth (36) for prying.

1 Claim, 4 Drawing Sheets

PANEL FLANGE OPENER FOR VEHICLE PANELS

BACKGROUND—FIELD OF INVENTION

This invention relates to vehicle panels, specifically for opening flanges of tabs that secure panels.

BACKGROUND—DESCRIPTION OF PRIOR ART

Auto body repair shops and salvage yards are frequently confronted with the task of repairing damaged auto body panels. A damaged panel must be removed from the panel frame to be repaired or replaced.

There is not a tool made to remove panels from panel frames, only a process which suffers from a number of disadvantages:

(a) The use of a power grinder with a grinding disk is the most popular way of removing a panel. The thin lip on the reverse side of the panel where it is folded over the frame is ground off, thereby allowing the panel to be removed. This process causes damage to the interior of the panel because a grinder can't be held secure enough to stay on that thin lip area for a prolonged period of time.

(b) Using a grinder becomes very costly over time. The cost of grinding disks, electricity, and repairs on the grinder prove costly over time.

(c) The use of a chisel to cut the lip and spot welds off the panels is another method of removing a panel. This process can cause considerable damage to the inner frame of the panel or the entire panel, rendering it useless. This forces the replacement of the entire panel instead of just a panel skin. Using this method is more likely to cause the repairman injury by either striking his hand with the hammer or by slipping and cutting himself with a sharp edge.

(d) In some cases a damaged panel can be removed, straightened and put back on if the inner lip is not destroyed. This is very seldom done because the use of a grinder of chisel will either grind away or destroy the lip that holds the panel on.

(e) The use of safety equipment is necessary when using a grinder or chisel, but can make the job more difficult. Heavy gloves and safety goggles are the common safety equipment used. The problem with gloves is that they are combersome and seem to create a lost sense of touch for the operator. Safety gaggles do keep flying chips of metal out of eyes, but they also seem to be permanently pitted, dirty, or fogged up, causing a safety hazard when clear viewing is needed for such precise work.

(f) Removing a panel in the processes mentioned are very time consuming. This creates more expense for the consumer. It also inhibits the repairman from using their time efficiently.

(g) A multitude of injuries can happen while removing a panel. Since most auto body repairman consider it a nuisance to were gloves or goggles, lacerations and eye injuries are common when using a chisel or grinder.

OBJECTS AND ADVANTAGES

Although the process I previously mentioned works, my invention provides many advantages and they are:

(a) to provide a hand tool which does not require any power to operate;

(b) to provide a new tool which drastically reduces the amount of time it takes to remove a panel;

(c) to provide a tool while will reduce the amount of injuries suffered when removing a panes;

(d) to provide a tool that enables removal of a panel with greater ease;

(e) to provide a tool that, after the initial cost, will reduce the cost of removing a panel; and (f) to provide a tool which will lessen the amount of damage to the panel and inner frame.

Further objects and advantages are to provide a tool that is reliable and durable. Still further objects and advantages will become apparent from a consideration of the ensuing descriptions and drawings.

DRAWING FIGURES

In the drawings, closely related figures have the same numbers but different alphabetic suffixes.

REFERENCE NUMBERS IN DRAWINGS

| | |
|---|---|
| 10 handle | 12 shaft |
| 14 flange roller rest | 16 flange roller tooth |
| 18 flange lip grove | 20 leverage pick guides |
| 22 leverage rack | 24 flange table |
| 26 flange guide tooth | 28 back |
| 30 roller gap | 32 leverage pick handle |
| 34 pick shaft | 36 leverage pick tooth |

DESCRIPTION—FIGS.

Figure 1A:
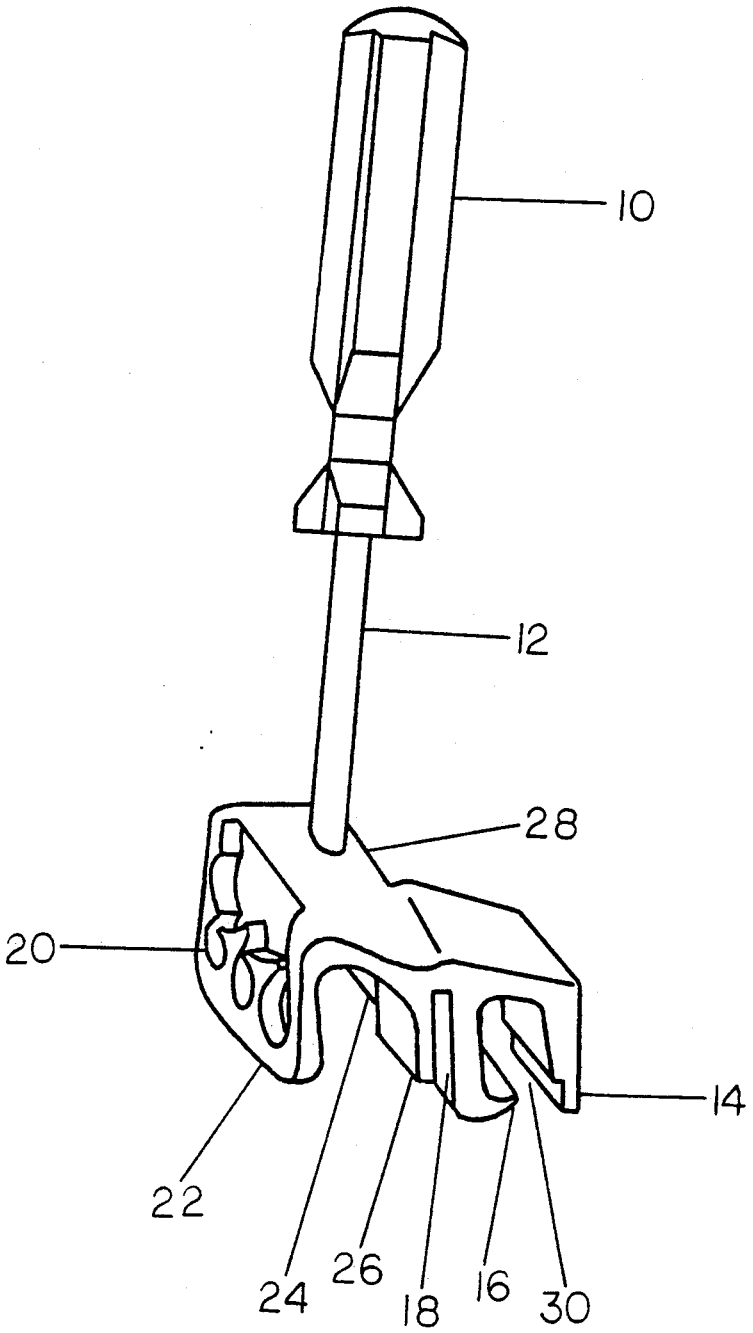
FIG. 1A and 1B show two aspects of the panel flange opener.
Figure 1B:
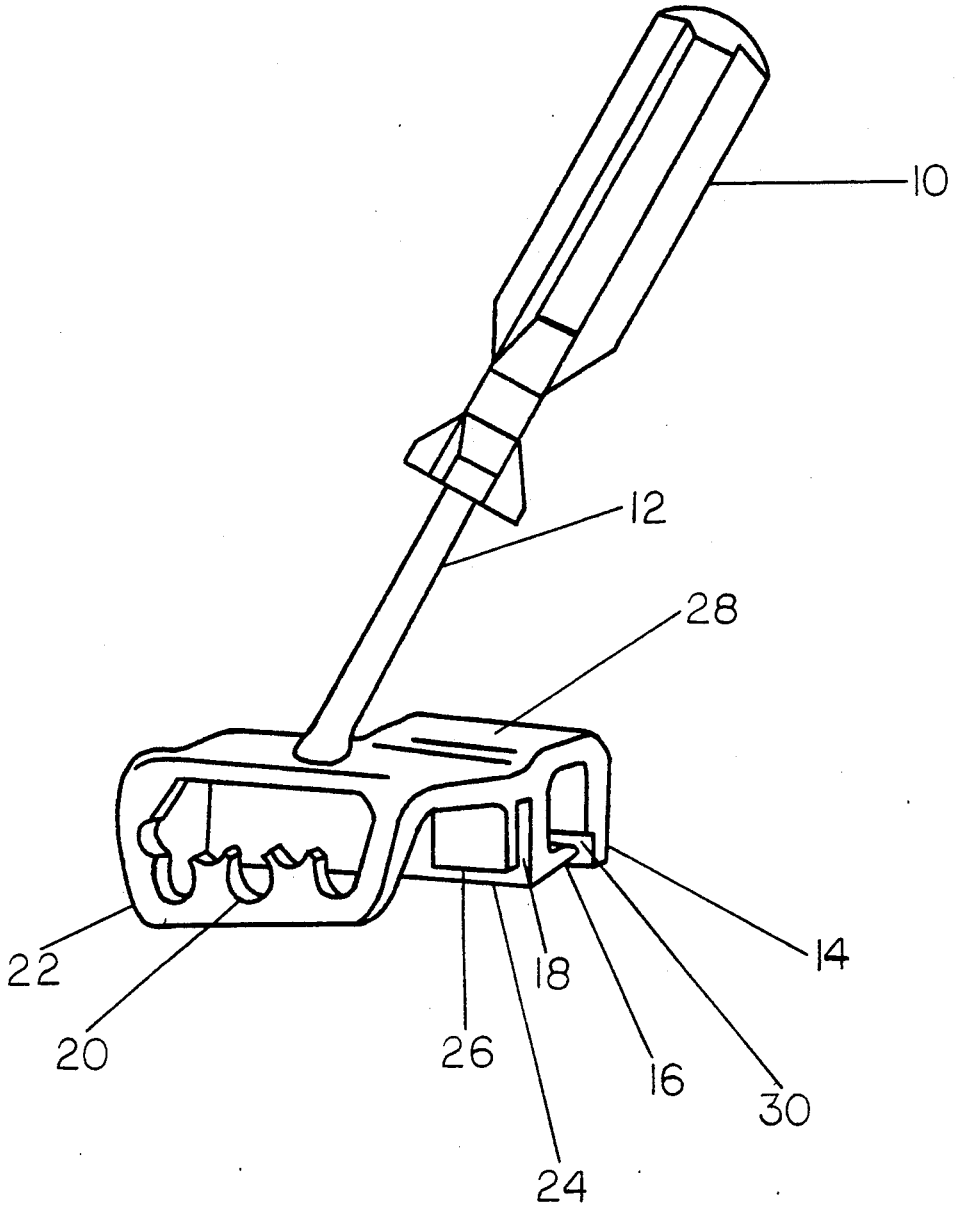

A typical embodiment of the two parts of the present invention are illustrate in FIG. 1A (a side auxiliary view) and FIG. 1B (a top view) of the leverage pick. At one end of the panel flange opener is the handle 10 which is connected to the typically 2" long shaft 12 that is connected to the body of the tool at approximately a 20 degree angle.

There are two features in the body of the tool. A roughly rectangular shaped side typically $2\frac{3}{4}$" long by $1\frac{1}{4}$" wide by $1\frac{1}{8}$" high, with rounded edges for safety, contains the leverage pick guides 20 which is at a 90 degree angle to the back 28 where the shaft 12 is connected. Aproximately $1\frac{1}{4}$" from the leverage pick guides 20 is the flange table 24 which is also at a 90 degree angle off the back 28. The typically $\frac{5}{8}$" by $\frac{1}{8}$" flange guide tooth 26 is situated on the left side of the tool apoximately $\frac{1}{4}$" from the flange table 24. The space between the flange guide tooth 26 and the flange table 24 is the flange lip groove 18.

The second feature of the panel flange opener is a 1" hollowed square with a $\frac{1}{4}$" elongated opening at the front that is connected to the bottom of the flange table 24 on the left side of the tool. The two parts of this feature are, the flange roller tooth 16 and the flange roller rest 14.

The second part of the invention is the leverage pick 2A and 2B. At one end of the leverage pick is the leverage pick handle 32 which is connected to the pick shaft which is typically 5" to $5\frac{1}{2}$" long that has the flared and angled 5/16" wide leverage pick tooth 36.

From the description, a number of advantages of my panel flange opener become evident:

(a) The tools compact construction allows it to be stored in a small space.

(b) The fact that the tool is a hand tool makes the task it performs easier.

(c) Since the tool surrounds the part of the panel being worked on, and all edges of the tool are rounded and smoothed the tool is very safe.

(d) The consolidation of the tool makes it very convenient and easy to use.

OPERATION—FIGS.

The manner of using the panel flange opener and leverage pick to remove panels works on the principle of leverage.

Figure 2A:
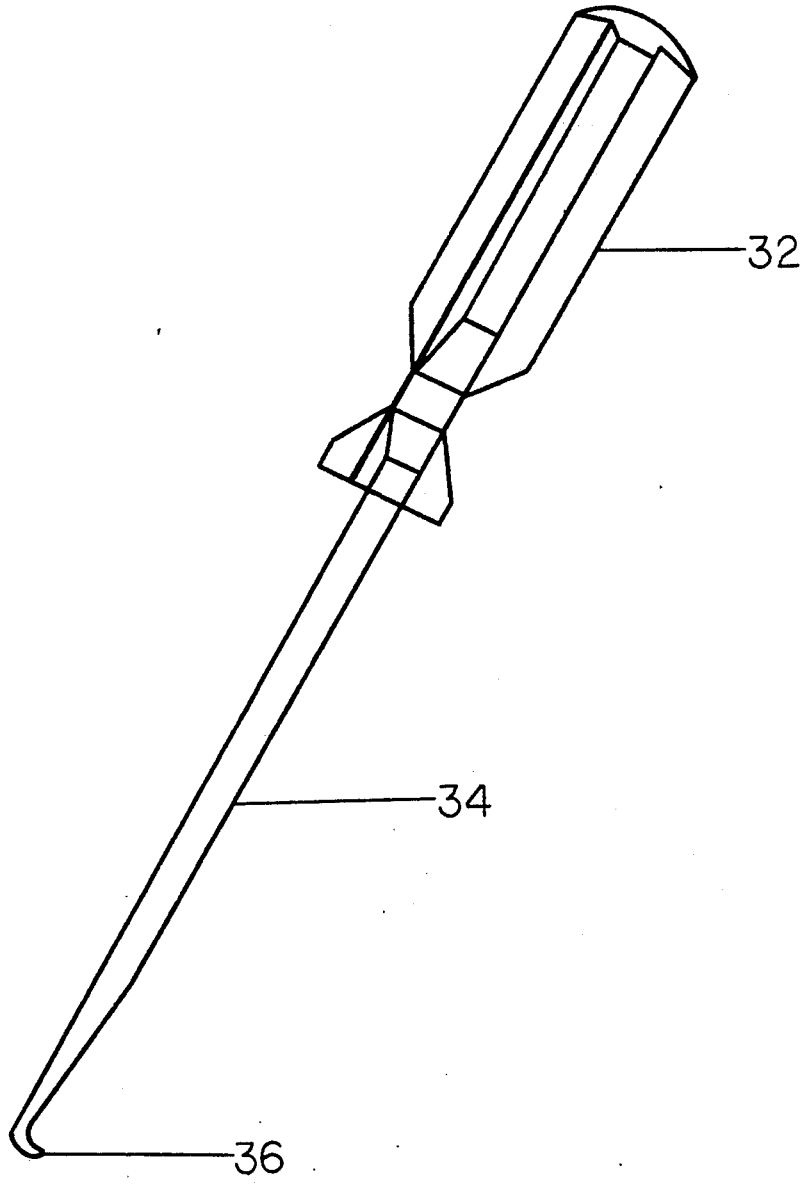
FIG. 2A and 2B show two aspects of the flange pick.
Figure 2B:
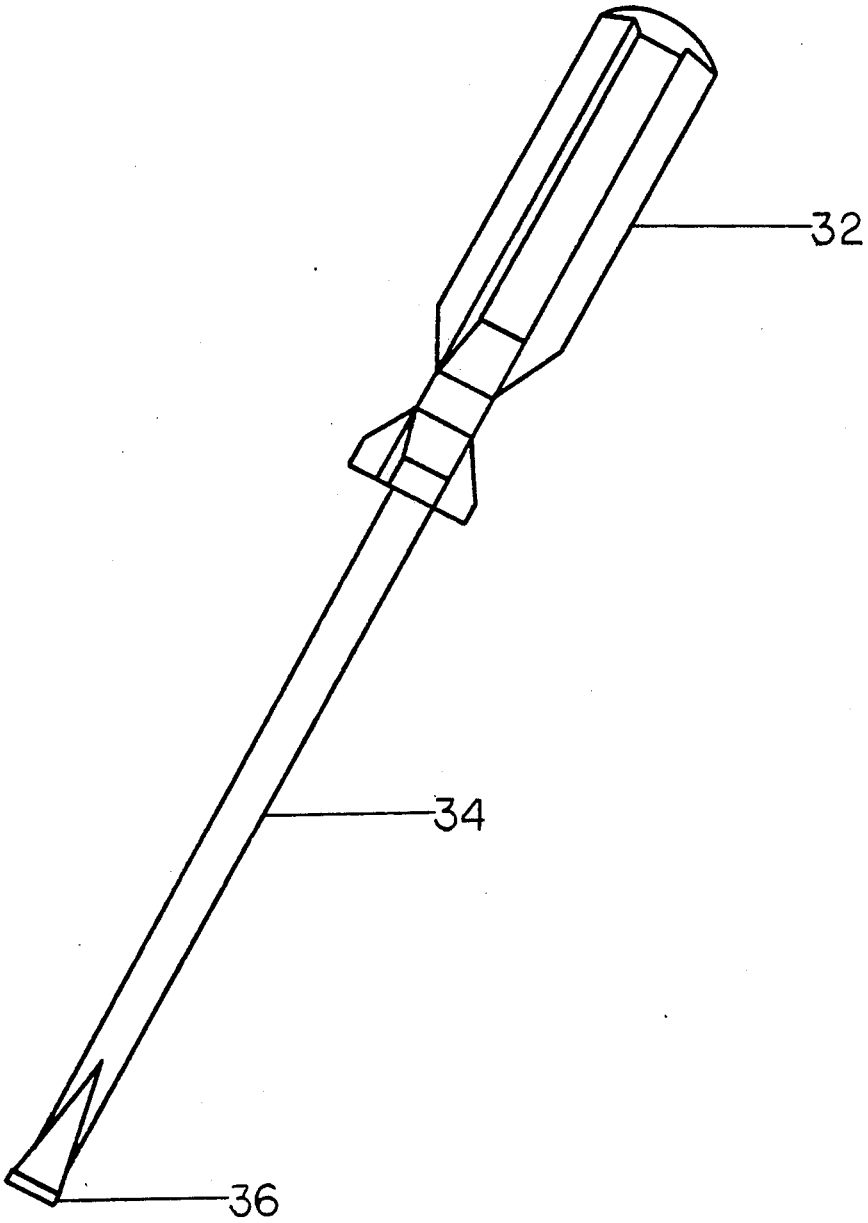

To remove a panel one first turns the panel upside down, then inserts the flange lip groove 18 over the panels flanged tip. Then one inserts the leverage pick (FIG. 2A and 2B) into a leverage pick guide 20 and pries open the lip with the leverage picks tooth 36. Once approximately an inch of the lip has been opened, one removes the leverage pick the panel flange opener from the panel to take advantage of the second feature of the tool. To perform the second feature simply insert the roller gap 30 over the portion of the lip that has been pried up, making sure that the flange roller rest is butted up against the exterior folded edge of the flange. With the flange roller tooth 16 on the inside of the lip that has just pried up simply pull the tool toward yourself. This pulling motion will roll the lip off the panel frame. Simply preform this process all the way around the door to remove the panel from its frame.

SUMMARY, RAMIFICATIONS, AND SCOPE

Accordingly, the reader will see that the panel flange opener and leverage pick provides a highly reliable, durable tool to remove panel skins. Furthermore, the panel flange opener and leverage pick has advantages in that:

it allows the process of removing a panel to be accomplished with greater ease;

it greatly reduces the amount of time it takes to remove a panel;

it provides a safer way to remove a panel;

it greatly reduces the number of hours and cost required to remove a panel;

it prevents the amount of damage that has occurred in the past when removing a panel.

Thus, the scope of the invention should be determined by the appended claims and their legal equivalents, rather then by the examples given.

I claim:

1. A pair of hand held tools used in conjunction to pry a flange away from a vehicle panel comprising: a first and second tool, and first tool of said pair of tools comprising a handle; a shaft; and a back having an upper and a lower surface, said shaft being connected at one end to said handle and at the other end centrally to said upper surface of said back, said back comprising on the lower surface thereof a centrally located flange lip groove for locating and holding a flange to be pried, a notched rack located to one side of said lip groove for guiding the second tool of said tool pair in prying of a flange away from a vehicle panel, and a hollowed square with an elongated opening located on the other side of said lip groove for rolling over a pried away flange, the second tool of said pair of tools comprising a handle and a longitudinal shaft, said longitudinal shaft being connected at one end to said handle, the other end of said longitudinal shaft being tapered downwardly to form a flat edge, said flat edge being curved upwardly toward the handle for prying away a flange from a vehicle panel when said longitudinal shaft of said second tool is located within the notched rack of the first tool.

* * * * *